US008408169B2

(12) United States Patent
Dybdal

(10) Patent No.: US 8,408,169 B2
(45) Date of Patent: Apr. 2, 2013

(54) METHOD AND ARRANGEMENT FOR CONTROL OF COOLING AND AN ENGINE

(75) Inventor: Rolf Dybdal, Jönåker (SE)

(73) Assignee: Scania CV AB (SE)

( * ) Notice: Subject to any disclaimer, the term of this patent is extended or adjusted under 35 U.S.C. 154(b) by 201 days.

(21) Appl. No.: 12/865,144

(22) PCT Filed: Jan. 22, 2009

(86) PCT No.: PCT/SE2009/050067

§ 371 (c)(1),
(2), (4) Date: Jul. 29, 2010

(87) PCT Pub. No.: WO2009/099384

PCT Pub. Date: Aug. 13, 2009

(65) Prior Publication Data

US 2010/0326376 A1 Dec. 30, 2010

(30) Foreign Application Priority Data

Feb. 4, 2008 (SE) ..... 0850008

(51) Int. Cl.
*F01P 7/10* (2006.01)

(52) U.S. Cl. ..... 123/41.59; 123/41.11; 123/41.49; 123/41.65; 165/41; 165/51; 416/169 A; 416/189

(58) Field of Classification Search ..... 123/41.11, 123/41.49, 41.59; 165/41, 51; 416/169 A, 416/189

See application file for complete search history.

(56) References Cited

U.S. PATENT DOCUMENTS

| | | | | |
|---|---|---|---|---|
| 4,387,780 | A * | 6/1983 | Fujikawa | 180/68.1 |
| 5,410,992 | A * | 5/1995 | Hunt et al. | 123/41.49 |
| 6,024,536 | A * | 2/2000 | Tsubakida et al. | 416/189 |
| 7,063,125 | B2 * | 6/2006 | Tembreull et al. | 165/41 |

FOREIGN PATENT DOCUMENTS

| | | | |
|---|---|---|---|
| EP | 0445804 | A1 | 9/1991 |
| EP | 0645543 | A1 | 3/1995 |
| JP | 59046316 | A * | 3/1984 |
| JP | 02130213 | A * | 5/1990 |

OTHER PUBLICATIONS

International Search Report dated Apr. 3, 2009orresponding international application No. PCT/SE2009/050067.

* cited by examiner

*Primary Examiner* — Noah Kamen
*Assistant Examiner* — Grant Moubry
(74) *Attorney, Agent, or Firm* — Ostrolenk Faber LLP

(57) ABSTRACT

At least one cooling device for a motor vehicle is aircooled by an air flow generated by a cooling fan of the motor vehicle. An air flow configuration of the cooling fan is determined by the fan's degree of protrusion from a fan ring running in the circumferential direction of the fan, preferably in air flow communication with a fan cowling. The air flow configuration is optimized in a manner controlled according to need by relocation of a movable portion of the fan ring in an axial direction of the fan. The disclosed method of controlling the air flow configuration is summarized above. A device performing the method and an engine for the motor vehicle including the device are also disclosed.

19 Claims, 2 Drawing Sheets

METHOD AND ARRANGEMENT FOR CONTROL OF COOLING AND AN ENGINE

CROSS REFERENCE TO RELATED APPLICATION

The present application is a 35 U.S.C. §§371 national phase conversion of PCT/SE2009/050067 filed Jan. 22, 2009, which claims priority of Swedish Application No. 0850008-4, filed Feb. 4, 2008, the disclosure of which is incorporated by reference herein. The International Application was published in the English Language.

BACKGROUND OF THE INVENTION

1. Technical Field

The present invention relates to a method and a device for adjusting and optimizing air flow in a vehicle engine past two components, particularly a radiator and a charge air cooler, using cooling air from an engine fan.

2. State of the Art

Technology substantially as described above is already known. For cooling both radiator liquid and charge air by the vehicle's cooling fan, the cooling fan is arranged relative to and, in suitable cases, protruding from a fixed fan ring to create a specified air flow configuration, which is a compromise for moderately satisfying a variety of operating situations. But, the extent to which it satisfies different operating situations varies. This is an inflexible solution and does not afford the possibility of controlling the cooling in accordance with current operating conditions, which involve varying cooling requirements and also depend on the speed of the fan and the amount of draught caused by movement of the vehicle.

In this respect, the object of the present invention is to propose a relatively simple, inexpensive and flexible solution to this problem which makes it possible to quickly and accurately adjust the cooling to different operating conditions.

SUMMARY OF THE INVENTION

The object indicated above and others are achieved by the invention. The object is also achieved with a device and an engine that perform in a method according to the invention. The invention concerns a method for control of cooling by means of an air flow configuration of a motor vehicle's cooling fan, whereby at least one cooling device, e.g. a radiator for radiator liquid and a cooler for charge air for the engine, is/are aircooled by an air flow generated by inter alia the fan, the method comprises the step of determining air flow configuration by the degree of protrusion of the fan from a fan ring running in the circumferential direction of the fan, and the fan ring is preferably in air flow communication with a fan cowling. The method is distinguished particularly by the step of optimizing the air flow configuration in manner controlled according to need by the degree of protrusion of the fan by relocation of a movable portion of the fan ring in the axial direction of the fan. The invention relates also to a device and an engine.

BRIEF DESCRIPTION OF THE DRAWINGS

The present invention should be better understood in the light of the following detailed description read together with the attached drawings, in which the same reference notations refer to similar items throughout the various views, and in which.

DETAILED DESCRIPTION OF PREFERRED EMBODIMENTS

Figure 1:
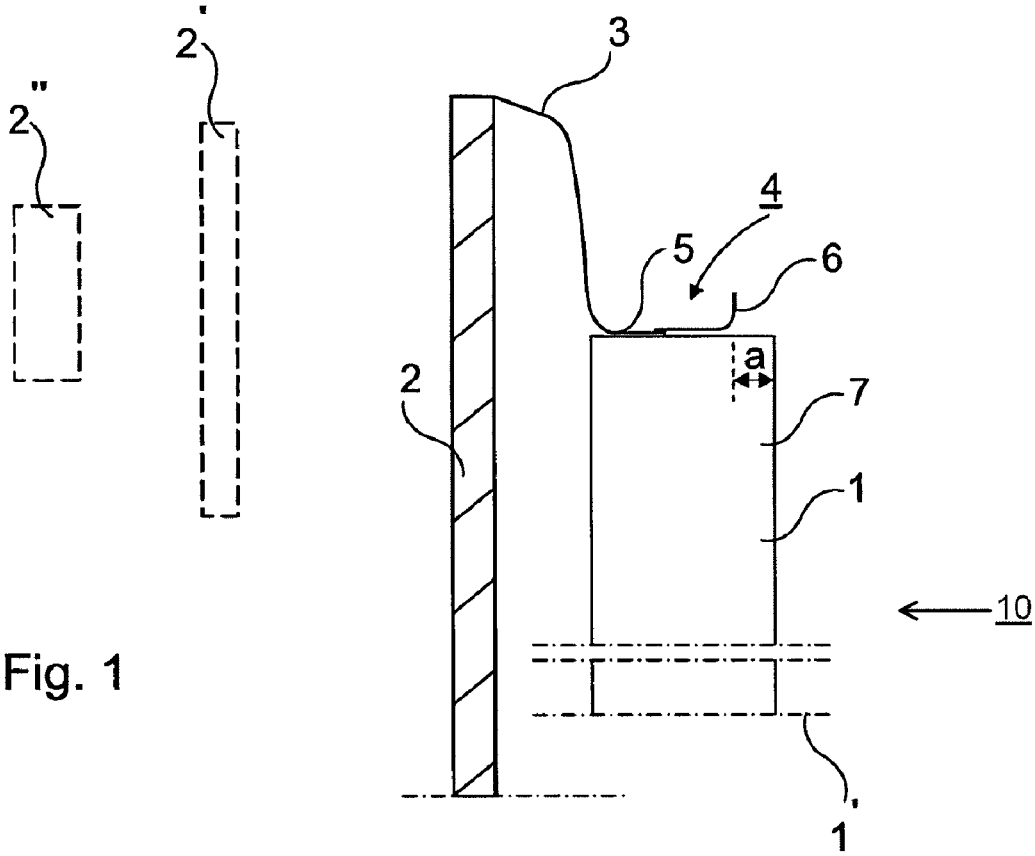
FIG. 1 depicts schematically an axial section through a first embodiment of a fan cooling arrangement according to the present invention.

In FIG. 1, a fan 10, includes a fan blade 1, and is intended for air cooling of, inter alia, a vehicle's radiator 2 and its radiator liquid. The fan is caused to rotate in a substantially known manner and at varying speeds depending on the speed of the vehicle's engine. That dependency relationship can usually be varied by so-called variable degree of connection.

A cooler 2' is drawn in discontinuous lines. It is configured for cooling of charge air for the vehicle's engine. An AC condenser 2" is configured for cooling with respect to the vehicle's air conditioning installation. Further cooling devices, e.g. an air-cooled oil cooler, may arise.

A fan cowling 3 extends circumferentially around the fan. It is configured to leading an air flow generated and drawn in by the fan to and past the radiator. Configurations in which the fan is of the forced draught may be used.

A fan ring 4 surrounds the fan. The ring is in air flow connection with the fan cowling 3. The fan ring is operable to vary the fan's axial degree of protrusion from the fan ring.

To this end, the fan ring comprises preferably a fixed portion 5 adjacent to the portion of the fan ring 4 which points towards and is preferably adjacent to the fan cowling, and a movable portion 6 which is movable axially relative to the fixed portion. By relocation of the portion 6 in the fan's axial direction 1', this movement varies the axial size of the fan portion 7 which protrudes from the fan ring, i.e. varies the fan's degree of protrusion relative to the fan ring, whereby the fan protrudes a variable distance a from the fan ring.

The fan's degree of protrusion constitutes part of the fan's air flow configuration and represents an accessible parameter for varying the air flow velocity imparted by the fan at different speeds. This optimises the air flow configuration according to need on the basis of various operating parameters of the vehicle, such as

- the speed of the fan;
- the velocity of the vehicle (the draught caused by movement of the vehicle);
- the need for cooled radiator liquid from the radiator;
- the need for cooled charge air for the engine;
- the need for air for the AC condenser;
- the need for EGR cooling;
- the need for gearbox oil cooling;
- etc.

Optimum air flow (mass flow of air) with respect to a certain speed is not the same for the radiator 2 for radiator liquid and for the cooler 2' for charge air, since these two cooling devices differ, inter alia, in their location, size etc. The invention enables, inter alia, optimisation of the air flow configuration with respect to cooled radiator liquid in response to a large need for such liquid or with respect to cooled charge air in response to a large need for such air or with respect to a combination of needs, i.e. a certain, albeit not maximum, need for cooled water and a certain, albeit not maximum, need for cooled charge air at a certain speed of the fan.

The optimisation is based primarily on the air flow provided by the fan at different operating speeds. To that end there is a preferably empirically determined relationship between the fan's degree of protrusion and the air flow from the fan. This relationship is arrived at with respect to different fan speeds, as a basis for the optimisation.

Against the background of what is described above concerning the optimum air flows for the two cooling devices, the relationship between the fan's degree of protrusion and the air flow has accordingly to be determined with respect to various speeds of the fan, preferably empirically, for the two cooling devices 2, 2'.

Figure 5:
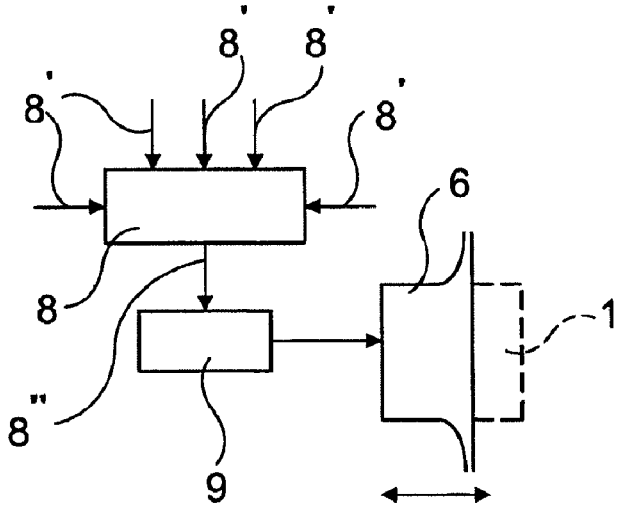
FIG. 5 depicts schematically an arrangement for optimising, inter alia by means of an axially movable fan ring portion, an air flow configuration of a vehicle fan adapted to cooling inter alia a radiator liquid of a vehicle radiator.
Figure 2:
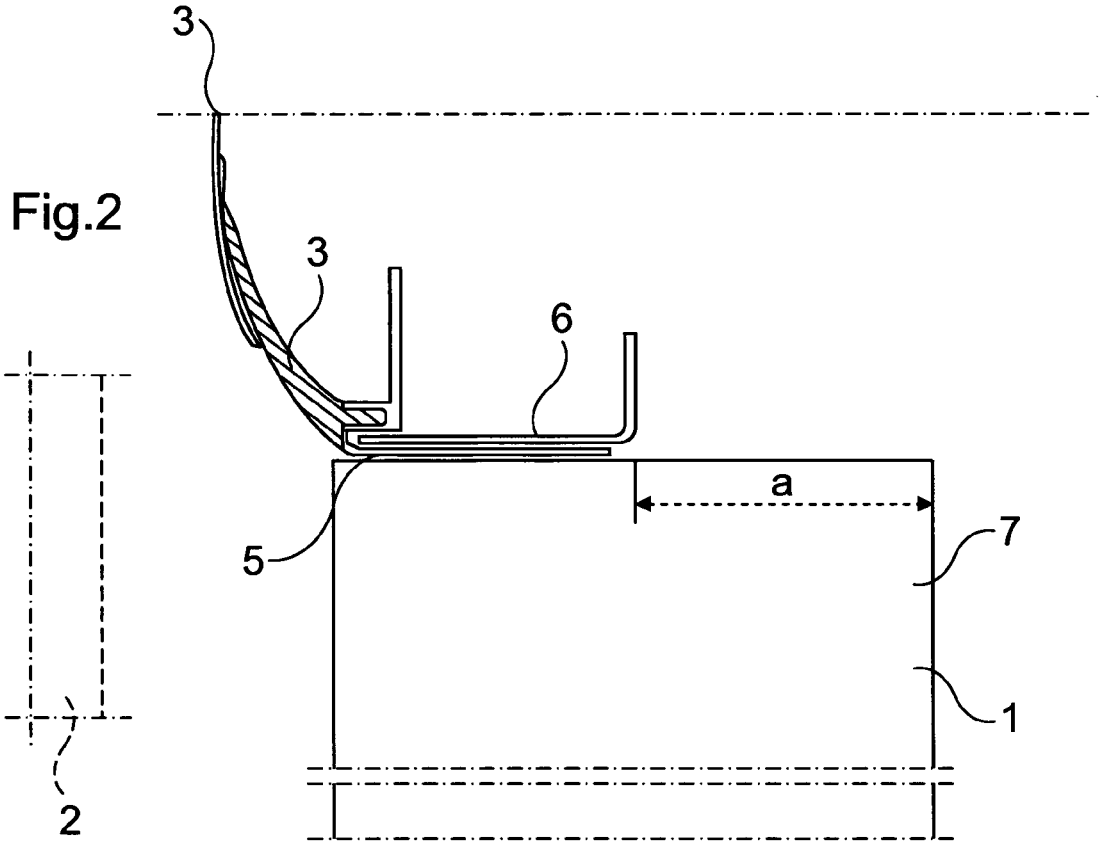
FIG. 2 depicts schematically in more detail an axial section of the embodiment substantially according to FIG. 1.

For carrying out the optimisation, a control unit 8 (FIG. 5), for example the vehicle's central control unit, is continuously supplied with a large amount of operating data of the vehicle, including fan speed, engine speed, engine power output, coolant temperature etc., represented by arrows 8'.

The control unit also has stored information in the form of the preferably empirically determined relationship between the fan's degree of protrusion and the air flow from the fan with respect to different speeds of the fan. That information is used for the optimisation, in a manner controlled according to need, of the air flow configuration at current speed based on operating parameters and operating situations received by the configured unit.

Devices 9 for automatic axial relocation (FIG. 5) act upon the air flow configuration by axial movement of the fan ring's movable portion, based on control signals 8" from the control unit for achieving the optimisation.

The devices for automatic axial relocation may be electrical, hydraulic, electromechanical, pneumatic or of other suitable kinds or combinations of suitable kinds.

Figure 3:
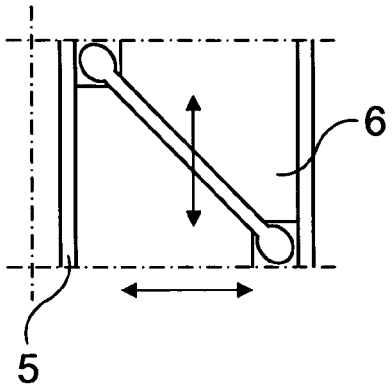
FIG. 3 depicts schematically a first embodiment of a device for axial relocation of a movable portion of a fan ring according to the present invention, in which relocation is effected by a rotary movement.
Figure 4:
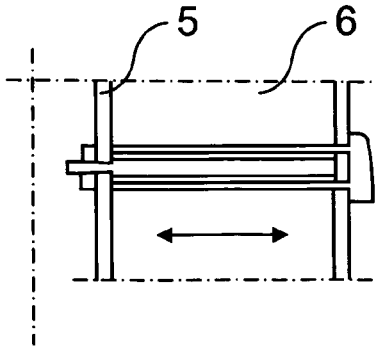
FIG. 4 depicts schematically a second embodiment of a device for axial relocation of a movable portion of a fan ring according to the present invention, in which relocation is effected by a direct axial linear movement.

Various solutions for effecting the relocation of a movable fan ring portion are conceivable. According to one version (FIG. 3), the relocation is effected by rotation of the movable portion relative to the fixed portion, as schematically depicted in the drawing. According to another version (FIG. 4), the relocation is effected by direct axial relocation of the movable portion of the fan ring relative to the fixed portion, as schematically depicted in the drawing.

The cooling fan's air flow configuration is thus determined and controlled by axial movement of a movable portion of the fan ring to vary the degree of protrusion of the fan from the fan ring. This varies the air flow provided by the fan at a specified speed of the fan. In this way the air flow can be adapted to current cooling needs, thereby making optimisation possible.

It may also be stated that the degree of fan protrusion is varied to maximize the fan's efficiency with respect to each fan speed at a desired operating point or in a specified operating situation.

The control also involves the fan speed, in suitable situations, being preferably controlled by the need for cooling air as determined by cooling needs for radiator liquid cooling devices and other heat exchangers concerned.

In situations where maximum cooling is desired as regards radiator liquid, the air flow configuration is thus optimised in such a way that the radiator 2 for radiator liquid undergoes maximum cooling and the air flow configuration is optimised accordingly. Such an operating situation may arise during braking by retarder, which involves a need for high capacity with regard to cooling of radiator liquid.

In situations where high cooling capacity with regard to both radiator liquid and charge air is desired, the air flow configuration is optimised in such a way that the radiator 2 and the cooler 2' are cooled as much as possible and the air flow configuration is optimised accordingly. Such an operating situation may be at a time of high power offtake from the engine.

In situations where high cooling capacity with regard to charge air is desired, the air flow configuration is optimised in such a way that the cooler 2' is cooled as much as possible and the air flow configuration is optimised accordingly.

As mentioned above, a more considered, complex and complete need for cooling may be adopted as the control basis.

Running optimisation is thus effected by the control unit on the basis of continuous supply of parameter values defining current operating situations and corresponding cooling needs.

The invention is described above in relation to preferred embodiments and embodiment examples.

More embodiments and also minor modifications and additions are of course conceivable without thereby departing from the basic concept of the invention.

Thus a more screwlike, e.g. a corkscrewlike, connection between the fan ring's fixed and movable portions is conceivable. A configuration similar to a bayonet socket arrangement is also conceivable.

The invention is thus not to be regarded as limited to the embodiments indicated above but may be varied within its scope indicated by the attached claims.

The invention claimed is:

1. A method for controlling cooling by adjusting an air flow configuration of a motor vehicle cooling fan, wherein the vehicle includes an engine, a charge air cooler for the engine, intake air, at least one cooling device for the engine, and the motor vehicle cooling fan which is for the cooler for charge air for the engine and for the at least one cooling device; the method comprising:

generating an air flow by the fan past the at least one cooling device and the cooler for charge air for the engine, determining an air flow configuration by the fan's degree of protrusion from a fan ring which extends in air flow communication with a fan cowling, the fan ring and the cowling extending in a circumferential direction around the fan, and optimizing the air flow configuration by selecting, by a control device, a degree of protrusion of the fan from the fan ring by relocating a movable portion of the fan ring in the axial direction of the fan.

2. The method according to claim 1, wherein the optimization is continuous based on at least one of the following parameters:

speed of the fan;

velocity of the vehicle measured as a draught caused by movement of the vehicle;

need for cooling the cooling device;

need for cooled charge air for the engine;

need for an AC condenser;

need for EGR cooling; and need for gearbox oil cooling.

3. The method according to claim 1, wherein the optimization is with respect to the air flow provided by the fan.

4. The method according to claim 1, further comprising providing the control device with information concerning a relationship representing the air flow provided by the fan according to the axial position of the movable fan ring portion and the speed of the fan.

5. The method according to claim 4, wherein the relationship is empirically determined.

6. The method according to claim 1, further comprising automatically relocating said movable portion of the fan ring axially on the basis of control signals from the control device for performing said optimization.

7. The method according to claim 1, further comprising controlling the optimization according to need on the basis of power offtake from the vehicle's engine.

8. A device for control of cooling by an air flow configuration of a motor vehicle's cooling fan, wherein the vehicle includes an engine, a cooling fan for the engine, and a fan ring circumferentially around the fan, a radiator for radiator liquid and a cooler for charge air for the engine being placed and configured to be air-cooled by an air flow generated by the fan, configuration of said air flow being intended to be affected by the fan having an adjustable degree of protrusion from the fan ring, a control device being operable to optimize said air flow configuration, in a manner controlled according to need, by adjusting said degree of protrusion of said fan from said fan ring, said fan ring having a movable portion which is movable in the axial direction of the fan by action of the control device.

9. The device according to claim 8, further comprising a fan cowling at the fan ring, the fan cowling extending away from the radiator and tapering in diameter in the direction of extension, the fan ring being in air flow communication with an end of the fan cowling spaced away from the radiator, the cowling being adjacent to the radiator for radiator liquid.

10. The device according to claim 8, wherein said optimization is governed by said control device continuously on the basis of at least one of the following parameters:

a speed of the fan;

a velocity of the vehicle (a draught caused by movement of the vehicle);

need for cooled radiator liquid from the radiator;

need for cooled charge air for the engine;

need for the AC condenser;

need for EGR cooling; and need for gearbox oil cooling.

11. The device according to claim 8, wherein the optimization is provided by control of the air flow provided by the fan.

12. The device according to claim 8, wherein said control device optimizes control of said fan.

13. The device according to claim 8, wherein said control device is configured and operable to receive information concerning a relationship representing the air flow provided by the fan according to the axial position of the movable fan ring portion and the speed of the fan and to optimize the air flow according to the information.

14. The device according to claim 13, wherein said control device is configured to determine said information empirically.

15. The device according to claim 8, further comprising devices configured for automatic axial relocation of said movable fan ring portion on the basis of control signals received from said control device for accomplishing said optimization.

16. The device according to claim 8, wherein said control device is configured to control the optimization on the basis of power offtake from the vehicle's engine.

17. The device according to claim 8, wherein said fan ring is comprised of a fixed portion via which said fan ring is adjacent to a fan cowling, the movable portion of the fan ring being arranged telescopically relative to said fixed portion and being operable for varying said degree of protrusion of said fan from said fan ring.

18. The device according to claim 17, wherein the axial movement of the fan ring's movable portion is caused by direct axial movement of the movable portion or by rotation of the movable portion relative to said fixed portion.

19. An engine for a motor vehicle comprising the device according to claim 8.

* * * * *